US009697753B2

(12) United States Patent
Johnson et al.

(10) Patent No.: US 9,697,753 B2
(45) Date of Patent: Jul. 4, 2017

(54) SHELF LABEL HOLDER

(71) Applicant: Target Brands, Inc., Minneapolis, MN (US)

(72) Inventors: Jason W. Johnson, Wayzata, MN (US); Erin L. Zobel, Minneapolis, MN (US); Nicholas C. Juric, Rockford, IL (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/876,968

(22) Filed: Oct. 7, 2015

(65) Prior Publication Data

US 2017/0103685 A1 Apr. 13, 2017

(51) Int. Cl.

| | |
|---|---|
| ***G09F 3/18*** | (2006.01) |
| ***G09F 3/20*** | (2006.01) |
| ***A47F 5/00*** | (2006.01) |

(52) U.S. Cl.

CPC ..... *G09F 3/204* (2013.01); *A47F 5/0043* (2013.01)

(58) Field of Classification Search

CPC ..... G09F 3/204
USPC ..... 40/661.03; 248/220.21; D20/43, 44
See application file for complete search history.

(56) References Cited

U.S. PATENT DOCUMENTS

| | | | | |
|---|---|---|---|---|
| 5,044,104 | A | 9/1991 | Hopperdietzel | |
| 6,105,295 | A * | 8/2000 | Brinkman | G09F 3/204 248/214 |
| 6,119,990 | A | 9/2000 | Kump et al. | |
| 6,145,232 | A | 11/2000 | Bevins | |
| 6,367,752 | B1 * | 4/2002 | Forsythe | G09F 3/204 248/220.21 |
| 6,470,613 | B1 * | 10/2002 | Wildrick | G09F 3/20 40/649 |
| 6,793,185 | B2 | 9/2004 | Joliey | |
| 6,935,061 | B2 | 8/2005 | Thompson | |
| 7,340,855 | B2 | 3/2008 | Wiltfang et al. | |
| 7,578,088 | B2 | 8/2009 | Alves | |
| 8,793,913 | B1 | 8/2014 | Zobel et al. | |
| 2004/0050812 | A1 | 3/2004 | Rojas et al. | |
| 2004/0178308 | A1 * | 9/2004 | Bacnik | G09F 3/204 248/223.41 |
| 2007/0245611 | A1 | 10/2007 | McDonald | |
| 2014/0196335 | A1 | 7/2014 | Barkdoll et al. | |

* cited by examiner

*Primary Examiner* — Joanne Silbermann
(74) *Attorney, Agent, or Firm* — Leanne Taveggia Farrell; Westman, Champlin & Koehler, P.A.

(57) ABSTRACT

A main body of a label holder is made of an opaque material and includes a main panel having a top end, a bottom end and a plurality of bends that define the main panel into a plurality of sections. The sections include a first substantially vertical section having a front facing surface that is spaced behind a front facing surface of a second substantially vertical section by a depth of a substantially horizontal section. A sign sleeve is at least partially made of a transparent material and is coupled to the front facing surface of the first substantially vertical section. The sign sleeve is located between the front facing surface of the first substantially vertical section and a plane that is in alignment with the front facing surface of the second substantially vertical section.

17 Claims, 6 Drawing Sheets

SHELF LABEL HOLDER

BACKGROUND

Businesses use a variety of types of display structures to present products and related information to customers for purchase. These display structures support both the product and shelf-type price label holders that receive printed material indicating the product price. An example display structure includes display shelves having price label holders.

The discussion above is merely provided for general background information and is not intended to be used as an aid in determining the scope of the claimed subject matter.

SUMMARY

A label holder includes a main body made of an opaque material and having a main panel. The main panel includes a top end, a bottom end and a plurality of bends that define the main panel into a plurality of connected sections. The plurality of connected sections include a first substantially vertical section having a front facing surface that is spaced behind a front facing surface of a second substantially vertical section by a depth of a substantially horizontal section. A sign sleeve is at least partially made of a transparent material and includes a main flange having at least a portion that is substantially planar and a return flange coupled to the main flange at a joined end. The return flange extends upward from the joined end and terminates along and is biased against the portion of the main flange that is substantially planar. A back surface of the main flange of the sign sleeve is coupled to the front facing surface of the first substantially vertical section of the main panel such that the sign sleeve is located between the front facing surface of the second substantially vertical section and a plane that is in alignment with the front facing surface of the second substantially vertical section.

A shelf assembly includes a shelf label holder engaged with a sign channel that extends along a front edge of a display shelf so as to hide the sign channel of the display shelf from view and present the display shelf with a flat front edge. The shelf label holder includes a main panel made of an opaque material and having a top end, a bottom end, a plurality of bends that define the main panel into a plurality of connected sections. The plurality of connected sections include at least two substantially vertical sections having front facing surfaces that are offset from each other by a substantially horizontal section so that the front facing surface of a first substantially vertical section is located along a plane that is behind a plane that the front facing surface of a second substantially vertical section is located along. A pocket is at least partially made of a transparent material and is coupled to the front facing surface of the first substantially vertical section of the main panel.

A method of altering a front edge of a display shelf is described. A shelf label holder is provided that has a main body made from an opaque material. The main body includes a main panel and having a top end, a bottom end, a plurality of bends that define the main panel into a plurality of sections. The plurality of sections include at least two substantially vertical sections having front facing surfaces that are offset from each other by a substantially horizontal section so that the front facing surface of a first substantially vertical section is located along a plane that is behind a plane that the front facing surface of a second substantially vertical section is located along. A sign sleeve is coupled to the front facing surface of the first substantially vertical section. The main body of the shelf label holder is attached to the front edge of the display shelf using supports that extend from the plurality of sections to engage with a sign channel on the front edge of the display shelf so as to hide the sign channel of the display shelf from view and present the display shelf with a flat front edge.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In a business, such as a retail store, display shelves are used to display products. Standard or existing display shelves include sign channels on their front edges. The sign channels are concave holders that house display price label (s) and are tilted at an upward angle so that customers can better view the displayed price label(s). As will be described in detail below, a concave sign channel is altered to look like a squared off shelf with a flat front edge by engaging a shelf label holder with the sign channel on the standard or existing display shelf. The engagement of the shelf label holder with the display shelf modifies or hides the existing front edge so that the appearance of the display shelf is uniform with other types of displays in the area.

The shelf label holder includes an opaque main body and an at least partially transparent sign sleeve or pocket for receiving printed media. The opaque body couples to and extends along the sign channel on the front of a shelf to make the front edge of the display shelf appear flat. Further, the opaque body when attached to the sign channel extends below the sign channel to make the front edge of the display shelf appear thicker. The at least partially transparent pocket is coupled to and extends along a front of a portion of the opaque body.

Figure 1:
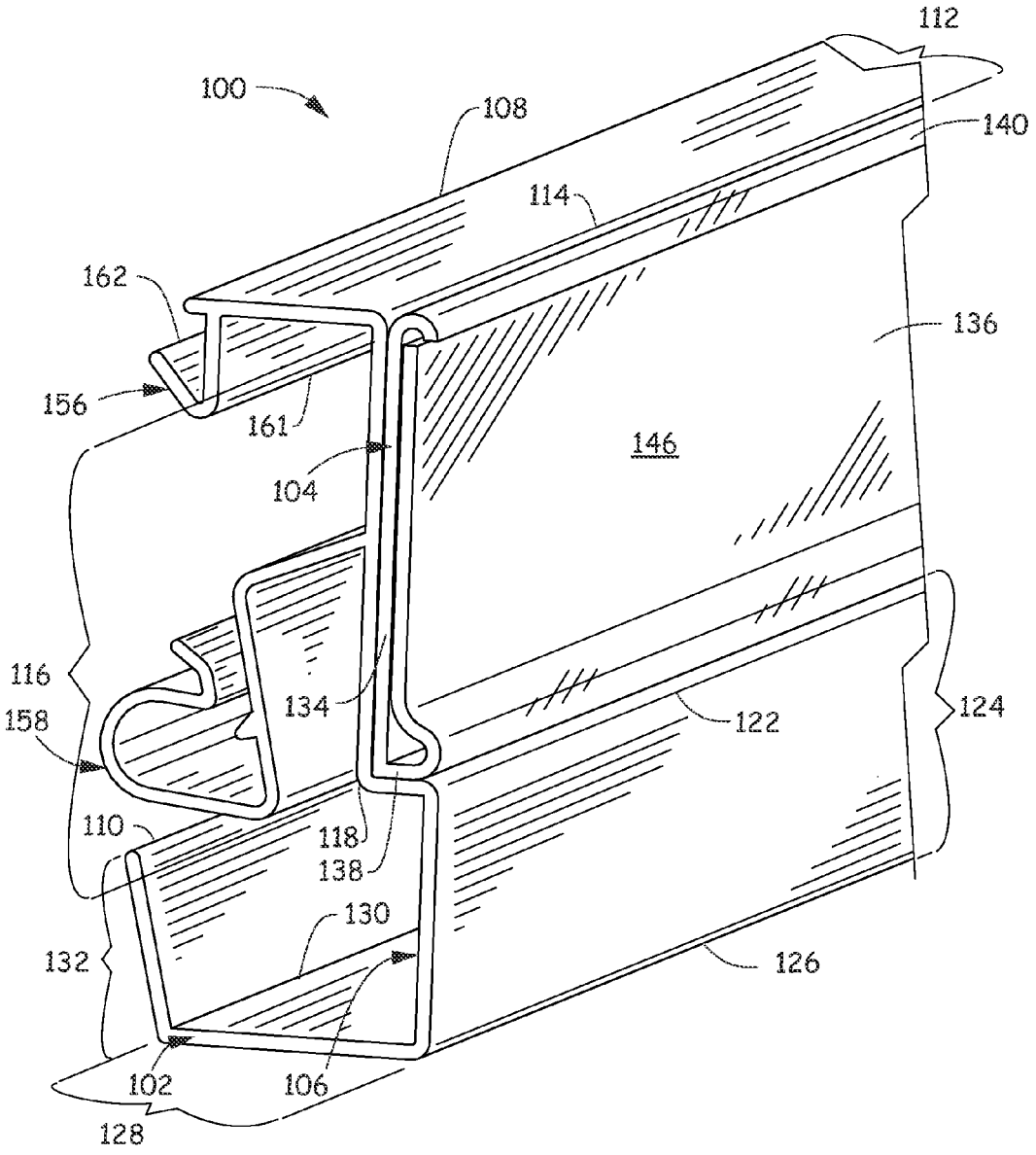
FIG. 1 is a perspective view of a portion of a shelf label holder according to one embodiment.
Figure 2:
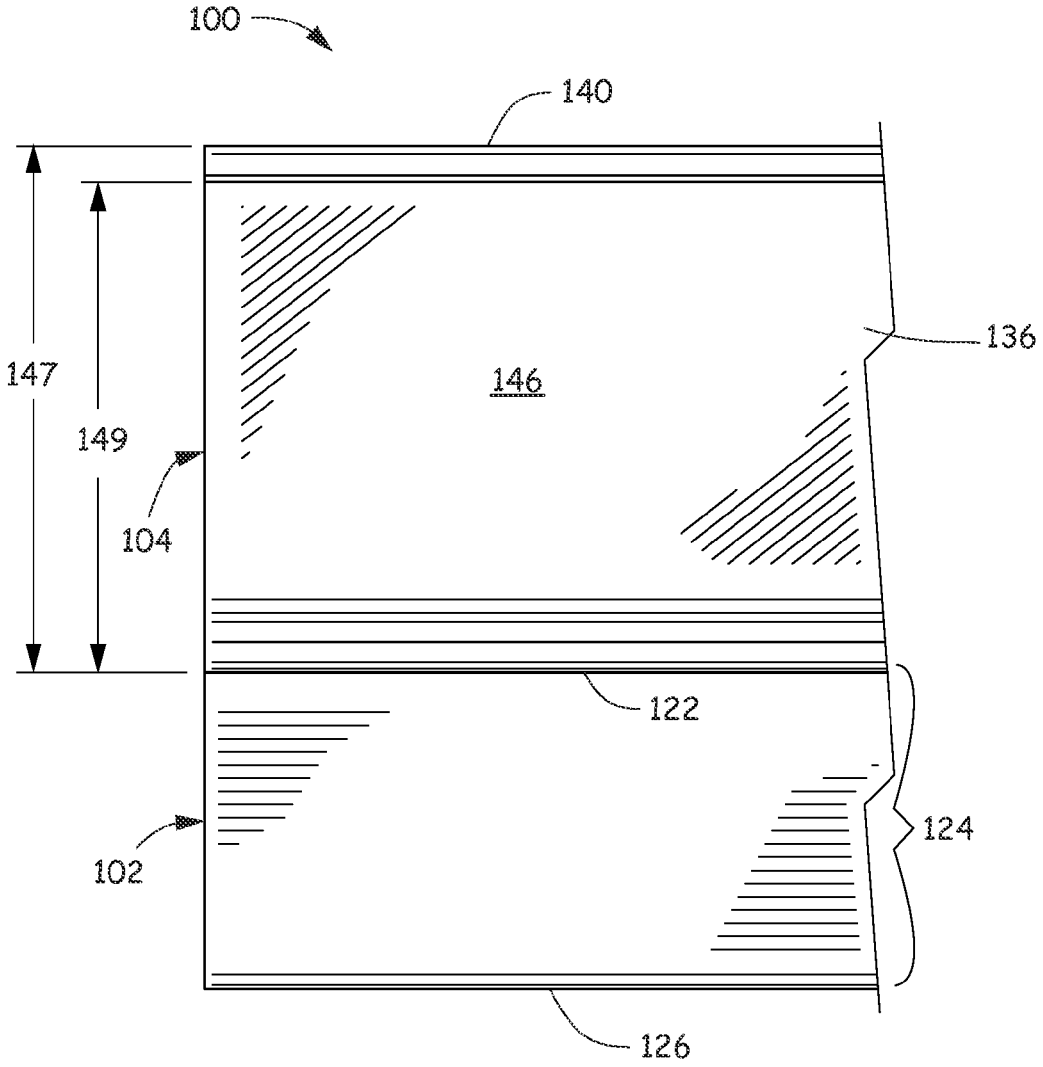
FIG. 2 is a front view of the portion of the shelf label holder illustrated in FIG. 1.
Figure 3:
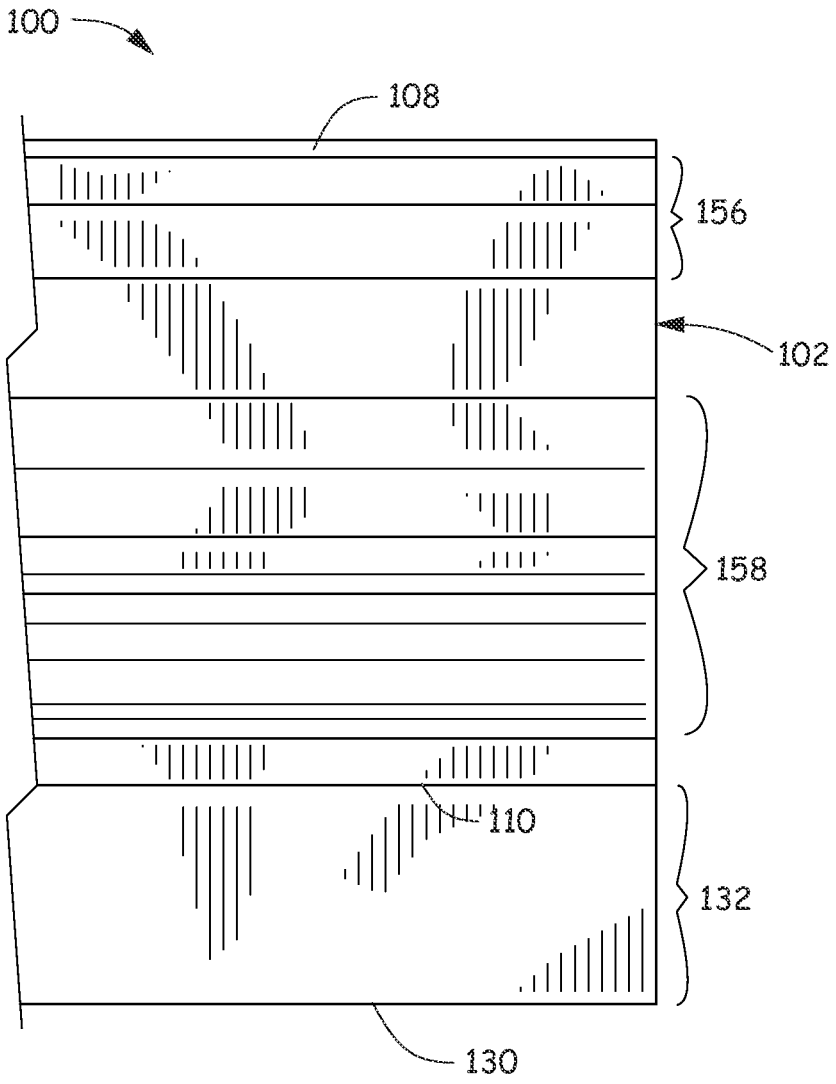
FIG. 3 is a back view of the portion of the shelf label holder illustrated in FIG. 1.

FIG. 1 is a perspective view of an end portion of a shelf label holder 100 according to one embodiment. A front view, a back view, a right side view (the left side view being a mirror image), a top view and a bottom view of the end portion are illustrated in FIGS. 2-6. Shelf label holder 100 includes two different components—a main body 102 and a sign sleeve or pocket 104 coupled to main body 102 by, for example, adhesive. In one embodiment, main body 102 is made of a single, continuous piece of material than can be formed, for example, by extruding a polymer or plastic or from a single sheet of material. Sign sleeve or pocket 104 is also made of a single continuous piece of material that can be formed, for example, by extruding a polymer or plastic.

In the illustrated embodiment, main body 102 includes a main panel 106 having a top end 108, a bottom end 110 and a plurality of bends that divide main panel 106 into a plurality of connected sections. A top section 112 is defined between top end 108 and a first bend 114 and is oriented substantially horizontally. A first substantially vertical section 116 is defined between first bend 114 and a second bend 118. A ledge section 120 (FIG. 4) is defined between second bend 118 and a third bend 122 and is oriented substantially horizontally. Ledge section 120 extends forward from first substantially vertical section 116. A second substantially vertical section 124 is defined between third bend 122 and a fourth bend 126. A bottom section 128 is defined between fourth bend 126 and a fifth bend 130 and is oriented substantially horizontally. Bottom section 128 extends backward from second substantially vertical section 124. A return section 132 is defined between fifth bend 130 and bottom end 110 has an internal surface 133 that is oriented at an obtuse angle 131 (i.e., greater than 90 degrees, but less than 180 degrees) relative to a top surface 129 of bottom section 128. Return section 132 will be discussed in more detail below.

Figure 4:
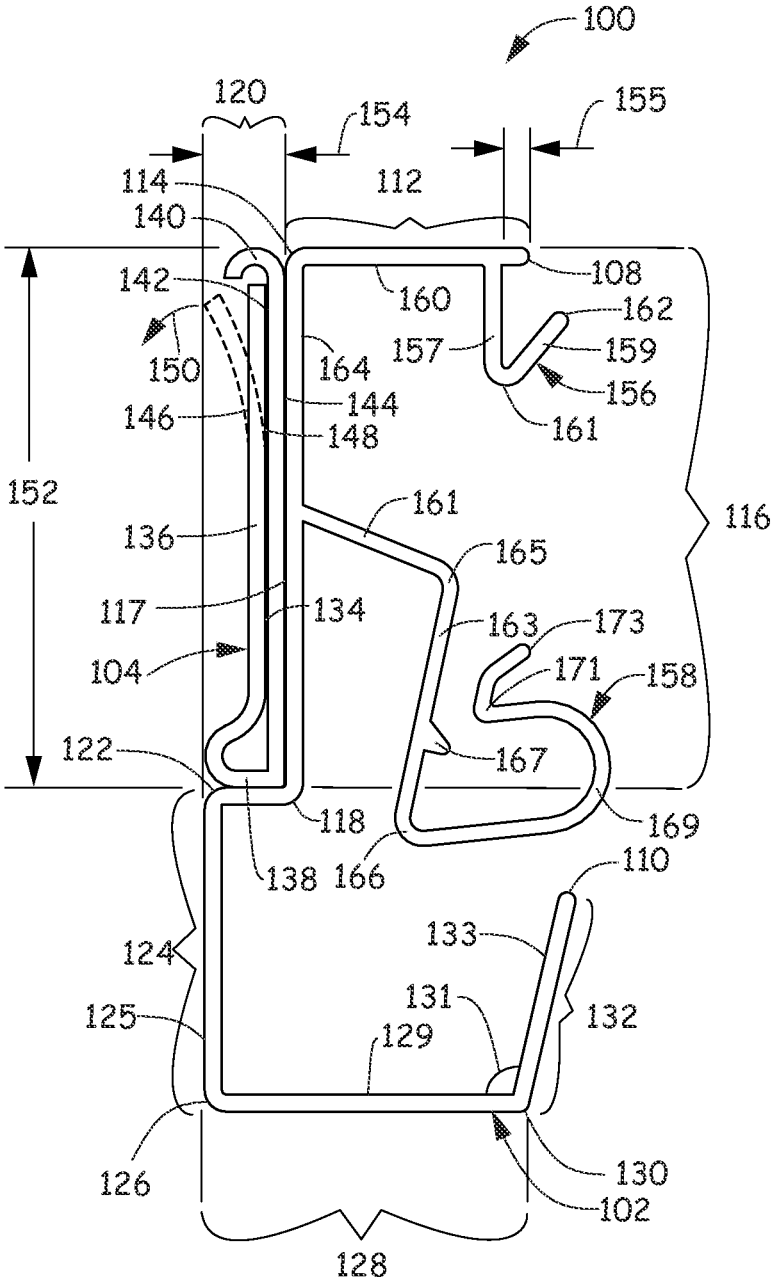
FIG. 4 is a right side view of the portion of the shelf label holder illustrated in FIG. 1.
Figure 5:
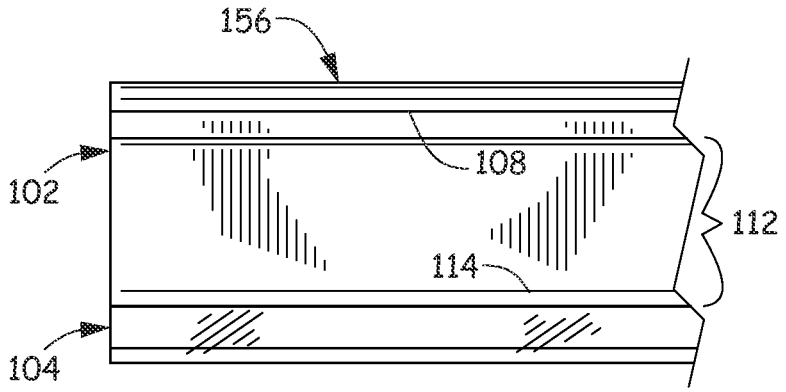
FIG. 5 is a top view of the portion of the shelf label holder illustrated in FIG. 1.
Figure 6:
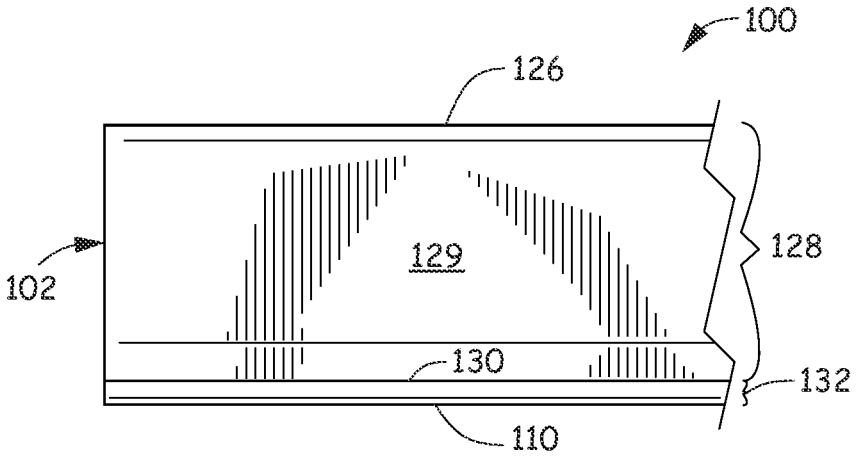
FIG. 6 is a bottom view of the portion of the shelf label holder illustrated in FIG. 1.

In the illustrated embodiment, sign sleeve or pocket 104 includes a main flange 134 having at least a portion that is substantially planar and a return flange or flap 136 that is coupled to main flange 134 at a joined end 138. Together main flange 134, return flange or flap 136 and joined end 138 define the sleeve or pocket for receiving printed media. At least return flange or flap 136 is made of a transparent material such that the printed media can be clearly viewed. In another embodiment, however, both main flange 134 and return flange 136 are made of a transparent material. Except for a top portion 140 of main flange 134, main flange 134 extends substantially planar as illustrated in FIG. 4. Top portion 140 of main flange 134 is a continuous curve such that top portion 140 of main flange 134 is partially oriented above the opening to the sleeve or pocket. Main flange 134 includes a front surface 142 and a back surface 144 opposite front surface 142 and return flange 136 includes a front surface 146 and a back surface 148 opposite front surface 146.

Return flange 136 extends from joined end 138 in a generally up-turned or upward manner and terminates along main flange 134 at a height 149 (FIG. 2) from joined end 138 that is less than a height 147 (FIG. 2) of main flange 134. In one embodiment, return flange 136 is substantially flexible and is biased towards main flange 134. More specifically, back surface 148 of return flange 136 is biased to interact with or contact a portion of front surface 142 of main flange 134. The flexible nature of return flange 136 allows return flange 136 to be rotated about joined end 138 as indicated by arrow 150 (FIG. 4). Rotation of return flange 136 allows a printed medium to be placed between return flange 136 and main flange 134 and into sign sleeve or pocket 104 in a top-down manner. In an alternative embodiment, a printed medium can be placed between return flange 136 and main panel 134 from a side of shelf label holder 100. In one embodiment, the printed medium placed in sign sleeve 104 can be thin gauge printable sheet material, such as paper, cardstock, paper board, etc., that is printed with textual and/or graphical indicia including generalized information relating to a number of particular items being displayed on the shelf to which shelf label holder 100 is attached, such as indicia indicative of brand identification, graphical designs and the like.

Sign sleeve 104 is coupled to or attached to first substantially vertical section 116 of main body 102. More specifically and under one embodiment, back surface 144 of main flange 134 is coupled to or adhered to a front facing surface 117 of first substantially vertical section 116. Therefore, first substantially vertical section 116 includes a height 152 (FIG. 4) that is substantially similar to or greater than the height 147 of main flange 134, which is the height of sign sleeve 104. In addition, ledge section 120, which is substantially horizontal, includes a depth 154 (FIG. 4) that is substantially similar to a thickness of joined end 138. In other words, front facing surface 117 of first substantially vertical section 116 is offset from a front facing surface 125 of second substantially vertical section 124. In this way, sign sleeve 104 fits neatly within the dimensions of main body 102 between front facing surface 117 and a plane that is in alignment with front facing surface 125 and with joined end 138 adjacent to ledge section 120. Therefore, shelf label holder 100 alters the front edge of a display shelf that has a standard or existing concave sign channel to appear to have a flat front. In particular, the most forward portions of sign sleeve 104, which are a front of joined end 138 and a front of top portion 140 of main flange 134, are confined within the plane that is in alignment with front facing surface 125 of second substantially vertical section 124 as illustrated in FIG. 4.

In one embodiment, a plurality of supports 156 and 158 are coupled to or are formed continuous with or integrally with main body 102 to engage shelf sign holder 100 with a sign channel on a front edge of a display shelf. First support 156 extends from a bottom surface 160 of top section 112, which is substantially horizontal, to a free end 162. In particular, first support 156 extends from bottom surface 160 of top section 112 at a distance 155 from top end 108. First support 156 includes a bend 161 that divides first support 156 into two legs 157 and 159. Together legs 157 and 159, bend 161 and end 162 form first support 156 into an up-turned hook. Second support 158 is located below first support 156 and extends from a back surface 164 of first substantially vertical section 116 to a free end 173. Second support 158 includes a first bend 165 and a second bend 166 that divides second support 158 into three legs. First leg 161 is defined between back surface 164 of first substantially vertical section 116 and first bend 165. Second leg 163 is defined between first bend 165 and second bend 166. Second leg 163 includes a nub 167 located on the backside of second leg 163 that protrudes downward. Extending from second bend 166 is a third leg 169 that follows an up-turned curve so that third leg 169 turns approximately 180 degrees to an elbow 171 and then extends further into a down-turned hook ending at free end 173. The plurality of supports 156 and 158 will be discussed in more detail below.

Figure 7:
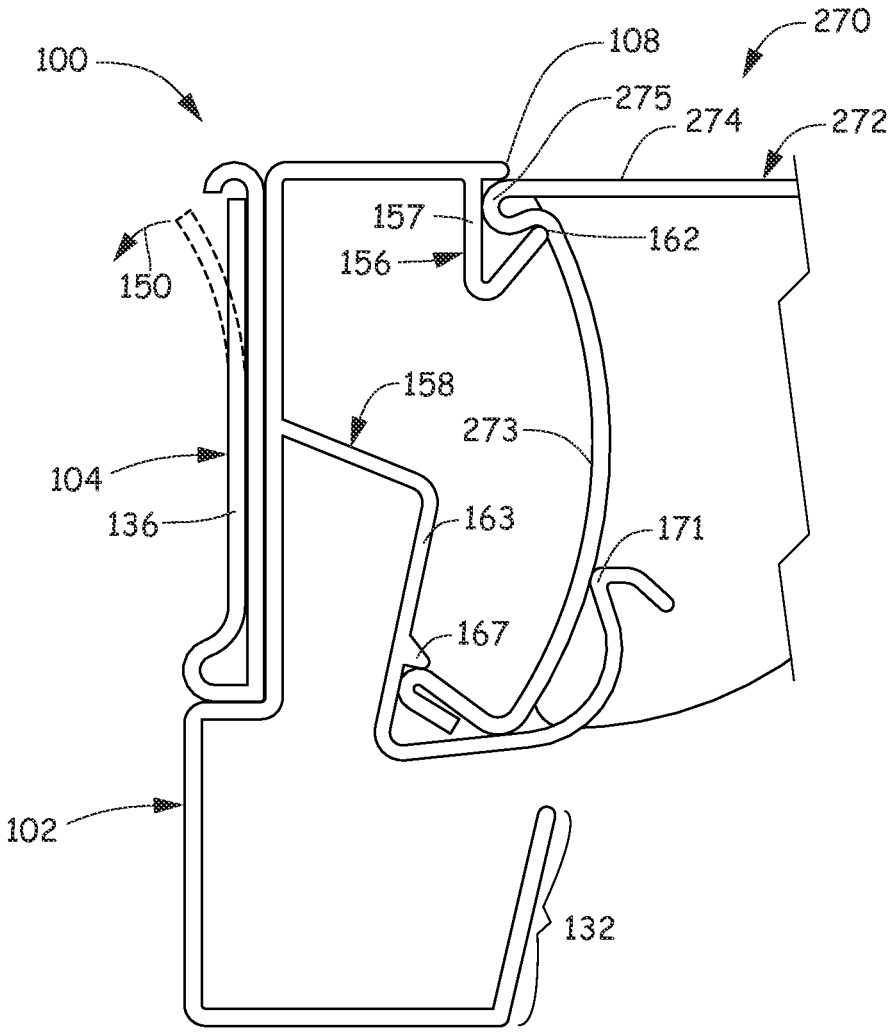
FIG. 7 is a right side view of a shelf assembly including the shelf label holder illustrated in FIGS. 1-6 assembled to a display shelf that has a sign channel according to one embodiment.

FIG. 7 is a right side view of a shelf assembly 270 with a right side end panel removed for purposes of illustration. Shelf assembly 270 includes a display shelf 272 having a sign channel 273 located on a front edge of shelf 272 and shelf label holder 100 (FIGS. 1-6) engaged with sign channel 273. Display shelf 272 is configured to hold and support a plurality of goods or products (not illustrated) that are being offered for sale. Display shelf 272 includes a shelf 274 and sign channel 273. Sign channel 273 is an open channel that is coupled to shelf 274 at a bull nose 275. Sign channel 273 is substantially C-shaped, extends along shelf 274 and is oriented at an angle from shelf 274 so that whatever type of printed material, such as price label strips or price labels that would normally be inserted into sign channel 273 would be tilted upwards for better viewing by a customer. However under these embodiments, shelf label holder 100 is coupled to sign channel 273. Shelf label holder 100 alters the front edge of display shelf 272 from having a tilted C-shaped channel 273 holding a price label to having a flat front edge holding a price label or, in other words, hiding sign channel 273 from view and presenting display shelf 272 with a flat front edge.

To engage or attach shelf label holder 100 to display shelf 272, a bottom of nub 167 on second leg 163 of second support 158 catches a bottom of sign channel 273 and third leg 169 of second support 158 wraps around a back of sign channel 273 such that elbow 171 presses against the back surface of sign channel 273. In addition, the up-turned hook of first support 156 engages with a top of sign channel 273. More specifically, first end 108 of main panel 102 in combination with first leg 157 of first support 156 mate with bull nose 275 of shelf 274 while free end 162 of first support 156 catches a top of sign channel 273. With both first support 156 and second support 158 engaged with sign channel 273, shelf label holder 100 is firmly secured to sign channel 273.

As previously described, after shelf label holder 100 is engaged with sign channel 273 of display shelf 272, a printed medium can be placed in or inserted into sign sleeve or pocket 104 of shelf label holder 100 as described above. Still further, after shelf label holder 100 is engaged with sign channel 273 of display shelf 272, the return section 132 of main panel 102 and its angled oriented position helps prevent product located on a shelf below from "catching" the bottom of main panel 102 as it is pulled off the shelf.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A label holder comprising:

a main body made of an opaque material and including a main panel having a top end, a bottom end and a plurality of bends that define the main panel into a plurality of connected sections, wherein the plurality of connected sections include a first vertical section having a front facing surface that is spaced behind a front facing surface of a second vertical section by a depth of a horizontal section;

a sign sleeve at least partially made of a transparent material and including a main flange having at least a portion that is planar and a return flange coupled to the main flange at a joined end, the return flange extending upward from the joined end and terminating along and being biased against the portion of the main flange that is planar; and wherein a back surface of the main flange of the sign sleeve is coupled to the front facing surface of the first vertical section of the main panel such that the sign sleeve is located between the front facing surface of the first vertical section and a plane that is in alignment with the front facing surface of the second vertical section; and wherein the main panel further comprises a horizontally oriented bottom section that is connected to the second vertical section by a bend, wherein the bottom section extends backward from the second vertical section.

2. The label holder of claim 1, wherein the main body further comprises a plurality of supports attached to the main panel.

3. The label holder of claim 2, wherein the plurality of supports comprises a first support that extends from a bottom surface of a horizontally oriented top section of the main panel to a free end, the first support including a bend that divides the first support into a two legs for defining an up-turned hook.

4. The label holder of claim 3, wherein the first support extends from the bottom surface of the top section at a distance from the top end of the main body.

5. The label holder of claim 3, wherein the plurality of supports comprise a second support that extends from a back surface of the first vertical section of the main panel to a free end, the second support including a first bend and a second bend that divide the second support into first, second and third legs.

6. The label holder of claim 5, wherein the second leg of the second support comprises a nub that protrudes downward from a back of the second leg.

7. The label holder of claim 5, wherein the third leg of the second support follows an up-turned curve to an elbow and extends further from the elbow into a down-turned hook.

8. The label holder of claim 1, wherein the main panel further comprises a return section that is connected to the bottom section of the main panel by a bend and terminates at the bottom end, wherein a surface of the return section is oriented from a top surface of the bottom section by an obtuse angle.

9. A label holder comprising:

a main panel made of an opaque material and having a top end, a bottom end, a plurality of bends that define the main panel into a plurality of connected sections, the plurality of connected sections including at least two vertical sections having front facing surfaces that are offset from each other by a horizontal section so that the front facing surface of a first vertical section is located along a plane that is behind a plane that the front facing surface of a second vertical section is located along;

a pocket at least partially made of a transparent material and coupled to the front facing surface of the first vertical section of the main panel; and a plurality of supports attached to the main panel, wherein the plurality of supports comprise a first support that extends from a bottom surface of a horizontally oriented top section of the main panel to a free end, the first support including a bend that divides the first support into two legs for defining an up-turned hook.

10. The label holder of claim 9, wherein the pocket further comprises:

a main flange that includes at least a portion that is planar; and a return flange coupled to the main flange at a joined end, extending upward from the joined end and terminating along and biased against the portion of the main flange that is planar.

11. The label holder of claim 9, wherein the up-turned hook of the first support engages with a top of a sign channel of a display shelf.

12. The label holder of claim 9, wherein the plurality of supports comprise a second support that extends from a back surface of the first vertical section of the main panel to a free end, the second support including a first bend and a second bend that divide the second support into first, second and third legs.

13. The label holder of claim 12, wherein the second leg of the second support comprises a nub that protrudes downward from a back of the second leg, wherein the nub engages with a bottom of a sign channel of a display shelf.

14. The label holder of claim 12, wherein the third leg of the second support follows an up-turned curve to an elbow and extends further from the elbow into a down-turned hook, wherein the up-turned curve to the elbow engages with a back side of a sign channel of a display shelf.

15. A label holder comprising:

a main body made from an opaque material and comprising a main panel having a top end, a bottom end, a plurality of bends that define the main panel into a plurality of sections, the plurality of sections including at least two vertical sections having front facing surfaces that are offset from each other by a horizontal section so that the front facing surface of a first vertical section is located along a plane that is behind a plane that the front facing surface of a second vertical section is located along;

a sign sleeve coupled to the front facing surface of the first vertical section;

wherein the main body further comprises a horizontally oriented bottom section that is connected to the second vertical section by a bend and wherein the bottom section extends backward from the second vertical section; and wherein the main body of the label holder attaches to the front edge of a display shelf using supports that extend from the main body to engage with a sign channel on the front edge of the display shelf so as to hide a sign channel on the display shelf from view and present the display shelf with a flat front edge.

16. The label holder of claim 15, further comprising a printed medium located in the sign sleeve.

17. The label holder of claim 15, wherein the main body further comprises:

a first support that extends from the main panel to a free end, the first support including a bend that divides the first support into a two legs for defining an up-turned hook, wherein the up-turned hook engages with a top of the sign channel; and a second support that extends from the main panel to a free end, the second support including a first bend and a second bend that divide the second support into first, second and third legs, wherein a nub protrudes downward from a back of the second leg to engage with a bottom of the sign channel and wherein the third leg follows an up-turned curve to an elbow that engages with a back side of the sign channel.

* * * * *